US009732566B2

(12) United States Patent
Mejia et al.

(10) Patent No.: US 9,732,566 B2
(45) Date of Patent: Aug. 15, 2017

(54) DOWNHOLE RELEASE TOOL

(71) Applicant: WEATHERFORD TECHNOLOGY HOLDINGS, LLC, Houston, TX (US)

(72) Inventors: Jose A. Mejia, Houston, TX (US); Jeffrey B. Wensrich, Houston, TX (US); Benjamin L. Todd, Cypress, TX (US); Michael Moody, Magnolia, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 312 days.

(21) Appl. No.: 14/550,030

(22) Filed: Nov. 21, 2014

(65) Prior Publication Data

US 2015/0144358 A1 May 28, 2015

Related U.S. Application Data

(60) Provisional application No. 61/907,762, filed on Nov. 22, 2013.

(51) Int. Cl.

| | |
|---|---|
| ***E21B 17/06*** | (2006.01) |
| ***E21B 23/00*** | (2006.01) |
| ***E21B 23/01*** | (2006.01) |
| ***E21B 23/06*** | (2006.01) |

(52) U.S. Cl.

CPC ..... *E21B 17/06* (2013.01); *E21B 23/006* (2013.01); *E21B 23/01* (2013.01); *E21B 23/06* (2013.01)

(58) Field of Classification Search

CPC ..... E21B 17/06; E21B 23/00; E21B 23/06; E21B 23/006; E21B 23/01

See application file for complete search history.

(56) References Cited

U.S. PATENT DOCUMENTS

| | | | | |
|---|---|---|---|---|
| 4,332,410 | A * | 6/1982 | Baker | E21B 31/18 294/86.18 |
| 4,449,587 | A * | 5/1984 | Rodenberger | E21B 34/102 166/323 |
| 4,869,325 | A | 9/1989 | Halbardier | |
| 5,050,682 | A | 9/1991 | Huber et al. | |
| 7,779,905 | B2 | 8/2010 | Carisella et al. | |
| 8,191,645 | B2 | 6/2012 | Carisella et al. | |
| 2005/0115720 | A1 | 6/2005 | MacKenzie et al. | |
| 2009/0308588 | A1 * | 12/2009 | Howell | E21B 21/103 166/66.4 |

(Continued)

FOREIGN PATENT DOCUMENTS

| | | |
|---|---|---|
| WO | 00/12862 A1 | 3/2000 |
| WO | 01/71154 A1 | 9/2001 |

OTHER PUBLICATIONS

International Search Report issued Nov. 30, 2015 for PCT Patent Application No. PCT/US14/066764, 6 pages.

(Continued)

*Primary Examiner* — Brad Harcourt

(74) *Attorney, Agent, or Firm* — Smith IP Services, P.C.

(57) ABSTRACT

A downhole tool has a release device for releasing a downhole device in a wellbore. The downhole tool has a collet with an inner surface and a collet shoulder; a release rod configured to engage the collet shoulder in a locked position and disengage from the collet shoulder in a release position; and a release tube surrounding the release rod and having a release ramp proximate a nose of the release tube.

31 Claims, 11 Drawing Sheets

(56) References Cited

U.S. PATENT DOCUMENTS

| | | | |
|---|---|---|---|
| 2013/0068533 | A1 | 3/2013 | Hradecky et al. |
| 2013/0175053 | A1 | 7/2013 | Madero et al. |

OTHER PUBLICATIONS

Written Opinion issued Nov. 30, 2015 for PCT Patent Application No. PCT/US14/066764, 10 pages.
Schlumberger, PosiSet Mechanical Plug-Back Tool, Aug. 1, 2004, 2 pages, Marketing Communications, Houston, Texas, United States.

* cited by examiner

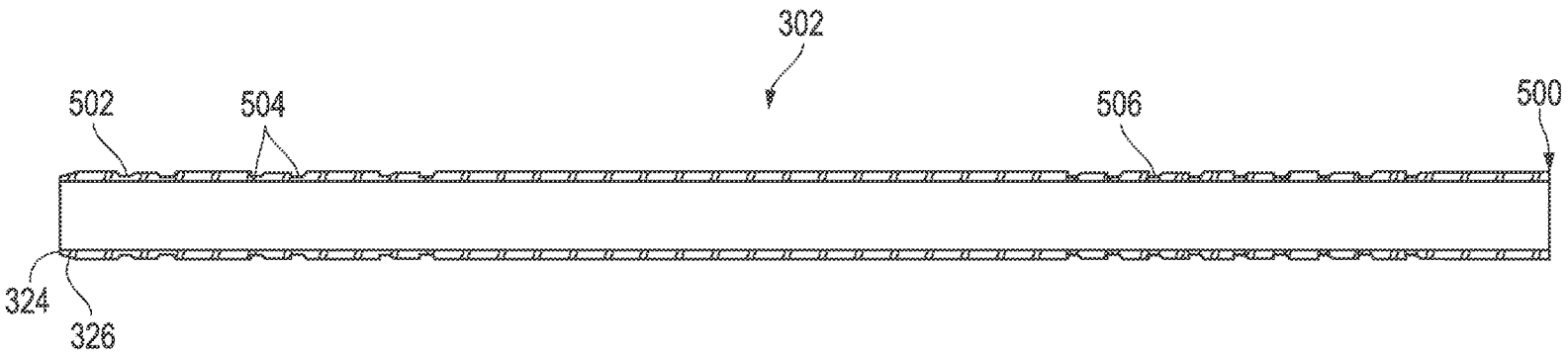
FIG. 5A
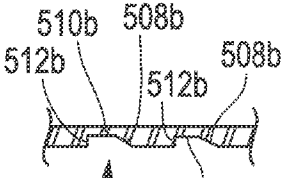
FIG. 5B
FIG. 5C
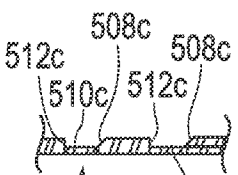
FIG. 5D

DOWNHOLE RELEASE TOOL

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM

Not Applicable.

BACKGROUND

Technical Field

The subject matter generally relates to techniques for releasing downhole tools in a wellbore. More particularly, the exemplary embodiments relate to techniques for releasing plugs in a wellbore.

Oilfield operations may be performed in order to extract fluids from the earth. There is a need to test the liner overlap in a more efficient, reliable and time saving manner.

BRIEF SUMMARY

The disclosure relates to exemplary embodiments of a downhole tool having a release device for releasing a downhole device in a wellbore. The downhole tool has a collet with an inner surface and a collet shoulder; a release rod configured to engage the collet shoulder in a locked position and disengage from the collet shoulder in a release position; and a release tube surrounding the release rod and having a release ramp proximate a nose of the release tube.

BRIEF DESCRIPTION OF THE SEVERAL VIEWS OF THE DRAWINGS

The exemplary embodiments may be better understood, and numerous objects, features, and advantages made apparent to those skilled in the art by referencing the accompanying drawings. These drawings are used to illustrate only typical exemplary embodiments of this invention, and are not to be considered limiting of its scope, for the invention may admit to other equally effective alternative exemplary embodiments. The figures are not necessarily to scale and certain features and certain views of the figures may be shown exaggerated in scale or in schematic in the interest of clarity and conciseness.

FIG. 5A depicts a cross sectional view of the release tube of the release device in an exemplary embodiment.

FIG. 5B depicts a cross sectional detail of the first ratchet profile according to an exemplary embodiment.

FIG. 5C depicts a cross sectional detail of the second ratchet profile according to an exemplary embodiment FIG. 5D depicts a cross sectional detail of the third ratchet profile according to an exemplary embodiment

DETAILED DESCRIPTION OF EXEMPLARY EMBODIMENT(S)

The description that follows includes exemplary apparatus, methods, techniques, and instruction sequences that embody techniques of the inventive subject matter. However, it is understood that the described exemplary embodiments may be practiced without these specific details.

Figure 1:
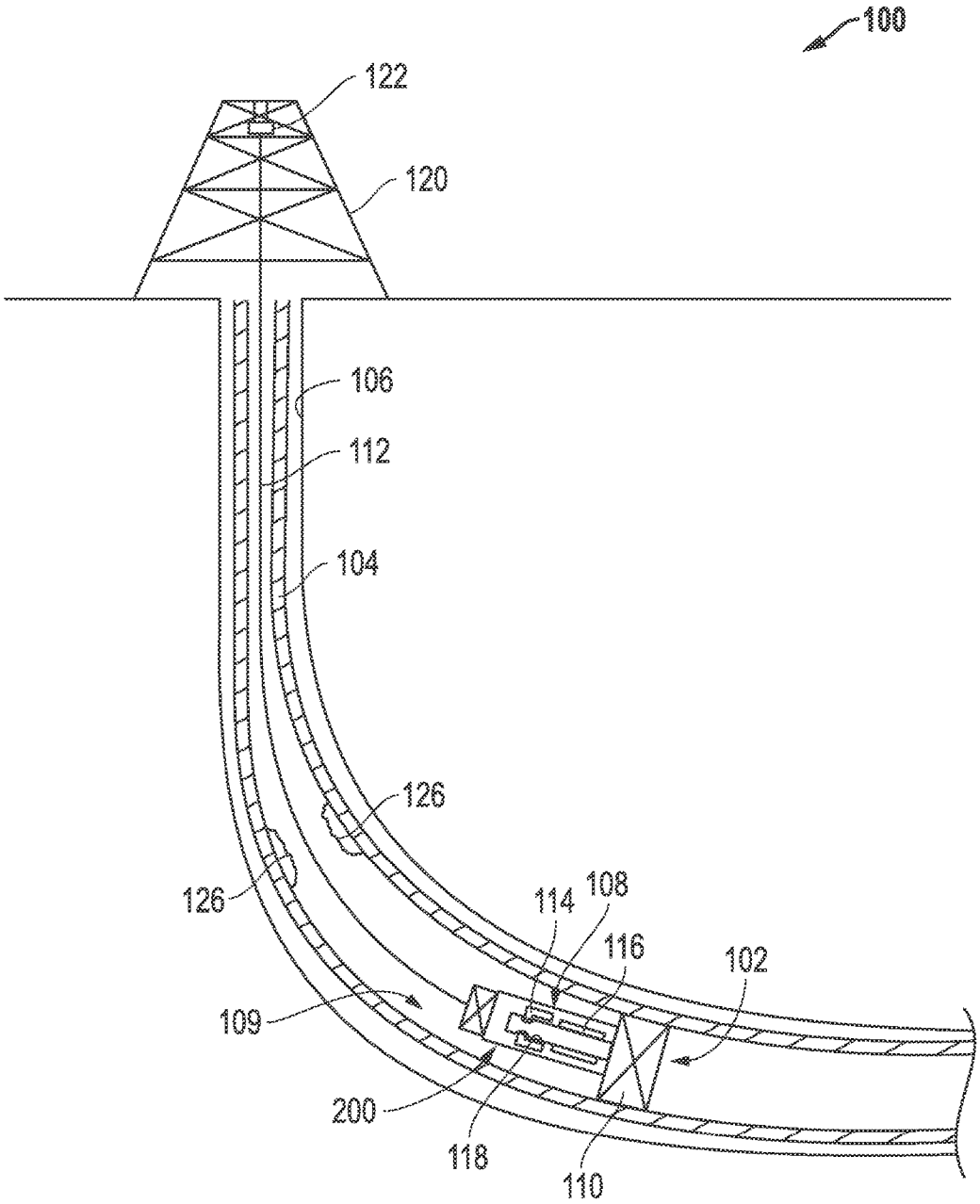
FIG. 1 depicts a schematic diagram, partially in cross-section, of a wellsite having a downhole tool with a release device for releasing a downhole tool from a wellbore in an exemplary embodiment.

FIG. 1 shows a schematic diagram depicting a wellsite 100 having a downhole tool 102 for sealing a tubular 104 in a wellbore 106. The downhole tool 102 may include a release device 108 for releasing the downhole tool 102 from the tubular 104. The downhole tool 102 may have one or more downhole devices 110 configured for use within the tubular 104. Potential downhole devices 110 may include, by way of example only: seals, packers, plugs, and perforators. In addition, the downhole device 110 may form a portion of a tool string 109 in the wellbore 106. The release device 108 may be configured to release the one or more downhole devices 110 from the tubular 104 by manipulating a conveyance 112. The release device 108 may have a collet 114 and a release tube 116. The manipulation of the conveyance 112 may cause the release tube 116 to engage an inner wall 118 of the collet 114 thereby releasing the collet 114 from a portion of the downhole tool 102. The release of the portion of the downhole tool may release the downhole tool 102 from the tubular 104 as will be discussed in more detail below.

The wellsite 100 may have a drilling rig 120 located above the wellbore 106. The drilling rig 120 may have a hoisting device 122 configured to raise and lower the tubular 104 and/or the downhole tool 102 into and/or out of the wellbore 106. The hoisting device 122 may be any suitable hoisting device for raising and lowering the downhole tool 102 into and out of the wellbore 106 including, but not limited to, a traveling block, a top drive, a winch, a Kelly drive, a pipe tongs, and the like.

The tubular 104 shown extending from the top of the wellbore 106 may be a casing. The casing may have been placed into the wellbore 106 during the forming of the wellbore 106 or thereafter. The casing may be any suitable sized casing for example, casing ranging from 4.5 inches-7.625 inches (11.4 cm-19.4 cm) casing, and the like. The casing may have one or more obstructions 126 that make the inner diameter of the casing smaller than intended.

Figure 1A:
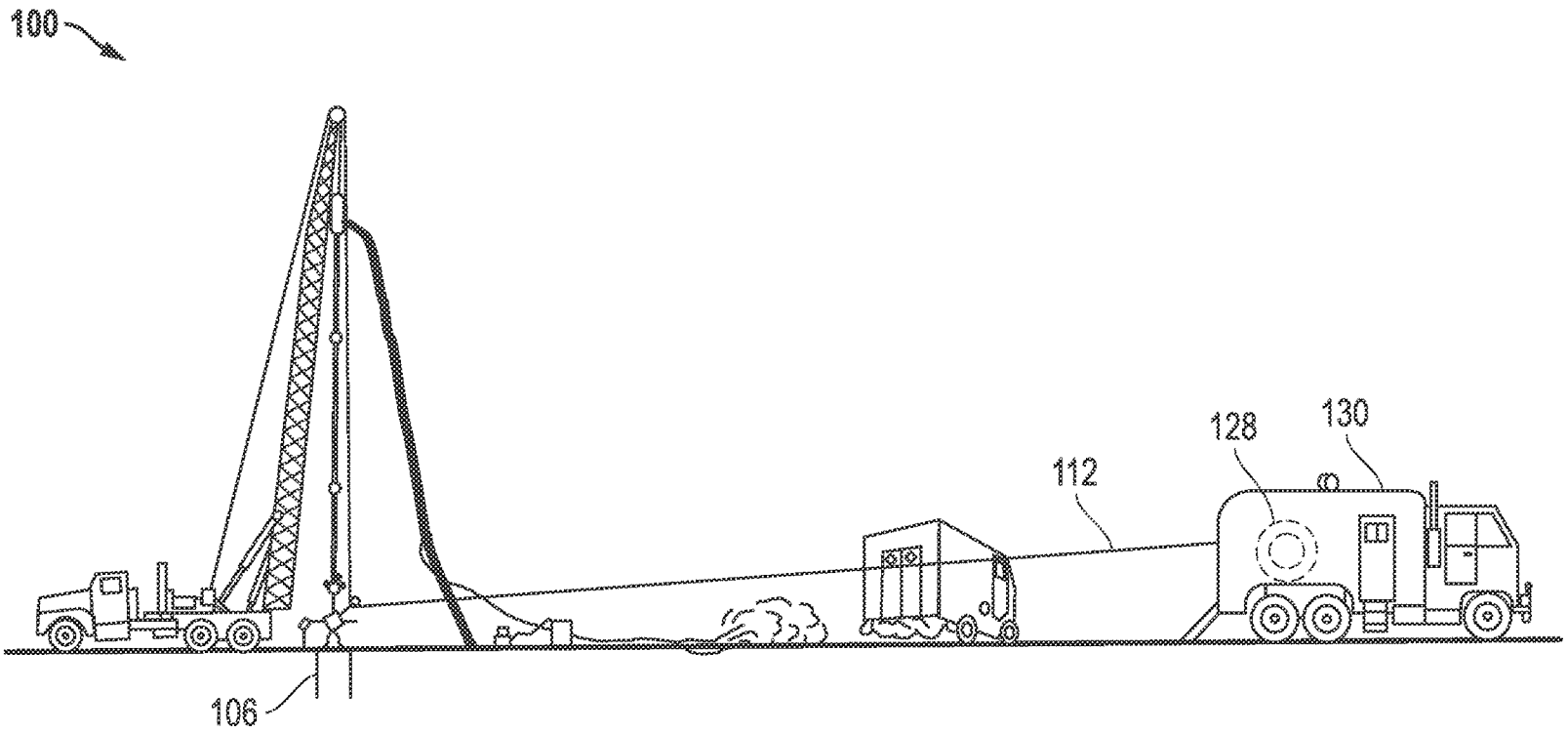
FIG. 1A depicts a schematic diagram of an exemplary embodiment of the wireline tool(s) at the wellsite showing a conveyance wrapped around a drum located on the back of a truck.

The downhole tool 102 may be lowered into the wellbore 106 using the conveyance 112. The conveyance 112, as shown, is a wireline that may be manipulated by the hoisting device 122 and/or any suitable equipment at the wellsite 100. In an alternate exemplary embodiment depicted in FIG. 1A, the wireline conveyance 112 may be wrapped around a drum 128 located in the back of a truck 130, or on a platform. The drum 128 may be powered by a motor to manipulate or apply force to the conveyance 112 at the wellsite 100 (via shift wheels and through a blow-out-preventer in the particular exemplary embodiment shown). Although the conveyance 112 is described as a drill string, it should be appreciated that any suitable device for delivering the downhole tool 102 into the wellbore 106 may be used including, but not limited to, any tubular string such as a coiled tubing, a production tubing, a casing, and the like.

In an exemplary embodiment, the downhole tool 102 is a positive sealing plug tool 200. The positive sealing plug tool 200 may be configured to run into the wellbore 106 on a wireline. The outer diameter of the positive sealing plug tool 200 may have the downhole device 110 (in one working example in the form of a sealing element) that expands to a much larger outer diameter than the outer diameter of the positive sealing plug. Therefore, the positive sealing plug tool 200 may allow the downhole tool 102 to pass the obstructions 126 in the casing and move to a location down hole of the obstructions 126. The positive sealing plug tool 200 may then be actuated using a signal sent down the wireline. Once set, the positive sealing plug tool 200 may seal the inner diameter of the tubular 104. The release device 108 may be used if the downhole tool 102 needs to be unset from the tubular 104. The positive sealing plug tool 200 is described in U.S. Pat. Nos. 8,191,645 and 7,779,905 which are herein incorporated by reference in their entirety. Although the downhole tool 102 is described as a positive sealing plug tool 200, it should be appreciated that the downhole tool 102 may be any suitable tool for sealing the tubular 104 including, but not limited to, a packer.

Figure 2:
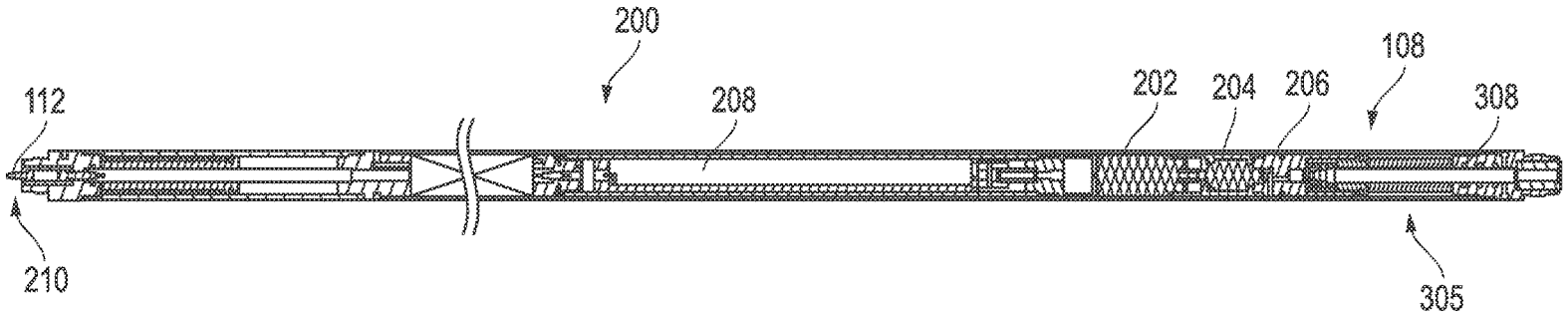
FIG. 2 depicts a cross sectional view of the downhole tool according to an exemplary embodiment.

FIGS. 2, 3 and 5A-5D depict an exemplary embodiment featuring a linear ratchet mechanism 305. FIG. 2 is a cross sectional view of the downhole tool 102 in an exemplary embodiment. The downhole tool 102, shown in FIG. 2, is the positive sealing plug tool 200 having the release device 108. The positive sealing plug tool 200 may include, but is not limited to, the release device 108, a motor 202, a pump 204, a piston seal pack 206, a controller 208, the downhole device (in this exemplary embodiment a seal element) 110 (represented schematically in FIG. 1), and a connector 210 for connecting the downhole tool 102 to the wire line or conveyance 112. The release device 108 has disengaged from a release rod 306 (shown in FIG. 3). With the release device 108 released from the release rod 306, the downhole tool 102 may be pulled out of the tubular using the conveyance 112. The release rod 306 and the downhole device 110 may be left in the tubular 104 (shown in FIG. 1) once the downhole tool 102 is removed.

Figure 3:
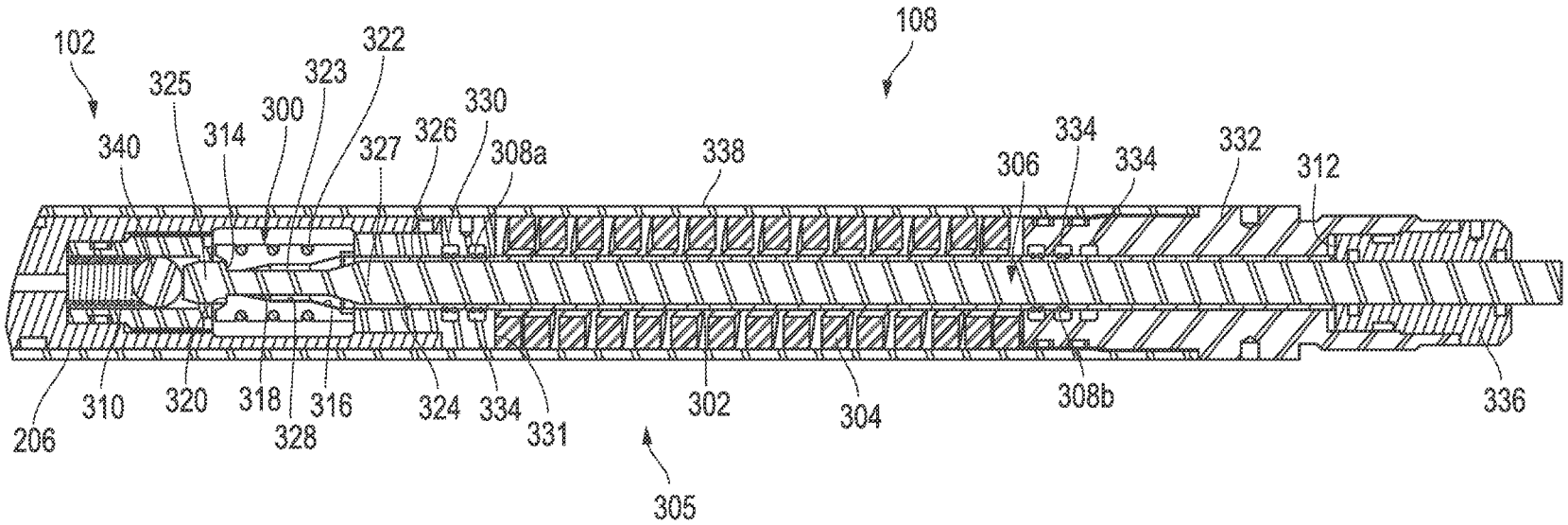
FIG. 3 depicts a cross sectional view of the release device of the downhole tool in an exemplary embodiment.

FIG. 3 depicts a cross sectional view of the release device 108 of the downhole tool 102 in an exemplary embodiment featuring a linear ratchet mechanism 305. The release device 108 may have a collet 300, a release tube 302, a compression spring 304, a release rod 306, one or more lock rings 308, and a release spring 310. The release device 108 is configured to release the release rod 306 from the collet 300 using uphole force applied to the conveyance 112 (shown in FIG. 1). On FIG. 3, the left hand side of the release device 108 is the uphole and proximal side of the tool and the right hand side of the release device 108 is the downhole and distal side of the tool. As uphole force is applied to the conveyance 112, the housing mandrel 338 pulls up on motive member mandrel 332 to overcome the spring rating of the compression spring 304. With the calculated spring rate of the compression spring 304 overcome, the release tube 302 may move uphole relative to the collet 300 and the release rod 306. Once the compression spring 304 has been compressed to its limit, the force on the conveyance 112 may be reduced or removed to allow the compression spring 304 to expand. The one or more lock rings 308 will hold the release tube 302 in place as the compression spring expands. This process is repeated until the release tube 302 motivates the collet 300 radially away from the release rod 306 thereby releasing the release rod 306 from the release device 108 and the downhole tool 102 as will be discussed in more detail below.

The collet 300 may be a substantially cylindrical device configured to expand radially away from a locking shoulder 314 of the release rod 306. The collet 300 may move from a locked position, as shown in FIG. 3, to a release position. In the locked position, the collet 300 prevents the locking shoulder 314 of the release rod 306 from passing through the collet 300. As the collet 300 moves radially away from the locking shoulder 314, the collet 300 releases the locking shoulder 314 and thereby the release rod 306 from the release device 108. The collet 300 may have an inner surface 301 which, in one exemplary embodiment (but not limited to), includes a first inner ramp 316, a second inner ramp 318, a collet shoulder 320, and one or more biasing members 322. As shown, the release rod 306 has a tapered portion 323 between a release rod head 325 and the release rod body 327. The tapered portion 323 may be configured to provide a necked down portion of the release rod 306 in order to form the locking shoulder 314 of the release rod 306.

The first inner ramp 316 may be configured to receive a nose 324 of the release tube 302 as the release tube 302 enters into the collet 300. As the nose 324 of the release tube 302 engages the first inner ramp 316, a release ramp 326 of the release tube 302 engages the first inner ramp 316. The continued longitudinal movement of the release ramp 326 into the collet 300 against the first inner ramp 316 causes the collet 300 to move radially away from the release rod 306. The first inner ramp 316 may be configured to move the collet 300 radially away from the release rod 306 without disengaging the collet 300 from the locking shoulder 314 of the release rod 306. In another exemplary embodiment, the first inner ramp 316 may be configured to move the collet 300 radially to a disengaged, or release position, thereby releasing the release rod 306 from the collet 300.

After the nose 324 of the release tube 302 passes the first inner ramp 316, the release tube 302 may pass a cylindrical inner wall 328 of the collet 300. The longitudinal movement of the release tube 302 may move the collet 300 radially away from the release rod 306 to the release position due to the release ramp 326 moving along the cylindrical inner wall 328. As shown, the cylindrical inner wall 328 is a substantially cylindrical inner wall of the collet 300 between the first inner ramp 316 and the second inner ramp 318. Although, the inner surface 301 of collet 300 is shown having the cylindrical inner wall 328 between the first inner ramp 316 and the second inner ramp 318, it should be appreciated that there may be no space between the first inner ramp 316 and the second inner ramp 318. Once the nose 324 passes the cylindrical inner wall 328, the nose 324 may engage the second inner ramp 318 with continued uphole longitudinal movement of the release tube 302. Although the exemplary embodiment illustrates two inner ramps of collet 300, it is to be appreciated that any combination of number of inner ramps and cylindrical walls may be implemented.

The second inner ramp 318 may be configured to receive the nose 324 of the release tube 302. The release ramp 326 may engage the second inner ramp 318 with continual longitudinal movement of the release tube 302 to further expand the collet 300 away from the release rod 306. The angle of the second inner ramp 318 may be the same as the angle of the first inner ramp 316 in an exemplary embodiment. Further, the second inner ramp 318 may have a different angle that the first inner ramp 316. For example, the first inner ramp 316 may have a slight angle configured to slowly move the collet radially away from the release rod 306 with longitudinal movement of the release tube 302 and the second inner ramp 318 may have a steep angle that moves the collet at a larger distance radially with the same longitudinal movement of the release tube 302, or vice versa.

Figure 4B:
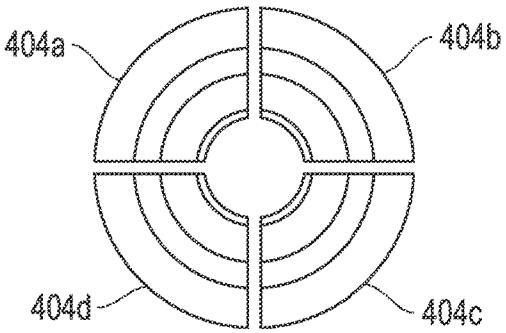
FIG. 4B depicts an end view of the collet according to an exemplary embodiment.
Figure 4A:
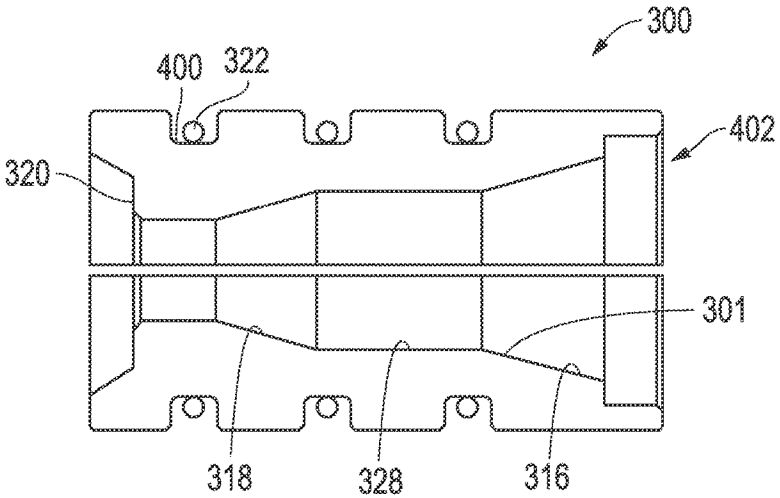
FIG. 4A depicts a cross sectional view of a collet according to an exemplary embodiment.

FIG. 4A depicts a cross sectional view of the collet 300 according to an exemplary embodiment. As shown, the collet 300 may have an inner surface 301 that includes the first inner ramp 316, the second inner ramp 318, the collet shoulder 320, the one or more biasing members 322, and one or more biasing grooves 400. A receiving end 402 of the collet 300 may be configured to receive the release tube 302 (as shown in FIG. 3) as it enters the collet 300. The first inner ramp 316 and the second inner ramp 318 as shown are planar although it is to be understood that other geometries or contours may be implemented in one or both (assuming two are implemented). The collet shoulder 320 may be configured to engage the locking shoulder 314 of the release rod 306 in the locked position, thereby preventing relative longitudinal movement of the release rod 306. As the collet 300 radially expands the collet shoulder 320 may disengage the locking shoulder 314 in the release position allowing the release rod 306 to move longitudinally down hole from the collet 300.

The one or more biasing members 322 may be configured to bias the collet 300 toward the locked position, thereby preventing inadvertent release of the release rod 306. The one or more biasing members 322 may rest in the one or more biasing grooves 400 in order to prevent damage to and longitudinal movement of the one or more biasing members 322. As shown, the one or more biasing members 322 are elastomeric O-rings, although, it should be appreciated that the one or more biasing members 322 may be any suitable biasing members including, but not limited to, coiled springs, leaf springs and the like.

FIG. 4B depicts an end view of the collet 300 from the receiving end 402 of the collet 300 according to an exemplary embodiment. As shown in FIG. 4B, the collet 300 may have four separate collet pieces 404*a-d*. The collet pieces 404*a-d* may be independent pieces that are free to move relative to one another. The biasing members 322 (as shown in FIG. 4A may bias the collet pieces 404*a-d* radially toward each other while the release tube 302 (as shown in FIG. 3) may move the collet pieces 404 radially away from one another when engaging the first and second inner ramps 316 and 318 (as shown in FIG. 4A) and cylindrical inner wall 328. Although there are four separate collet pieces 404*a-d* shown, it should be appreciated that any number of collet pieces 404*a-d* may be used as long as the collet pieces 404*a-d* are free to move relative to one another as a result of the biasing members 322 and the release tube 302.

Figure 4C:
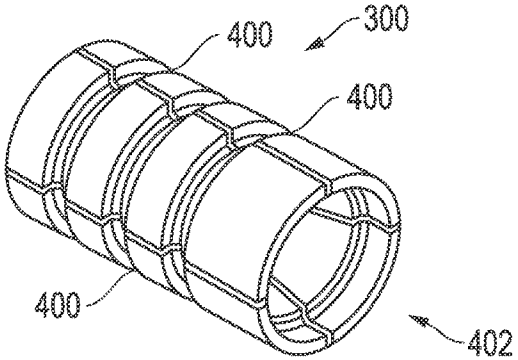
FIG. 4C depicts a perspective view of the collet according to an exemplary embodiment.

FIG. 4C depicts a perspective view of the collet 300 according to an exemplary embodiment. The collet 300 is shown having the one more biasing grooves 400 before the biasing members 322 (as shown in FIG. 4A) are placed in the biasing grooves 400.

FIG. 5A depicts a cross sectional view of the release tube 302 according to an exemplary embodiment. The release tube 302 may have the nose 324, the release ramp 326, a tail end 500, one or more first ratchet profiles 502, one or more second ratchet profiles 504, and one or more third ratchet profiles 506. The release ramp 326 as shown is planar although it is to be understood that other geometries or contours may be implemented. The first, second and third ratchet profiles 502, 504 and 506 may be configured to engage the lock rings 308 (as shown in FIG. 3) as the release tube 302 is moved longitudinally along the downhole tool 102 (as shown in FIG. 1). The lock rings 308 and the first, second and third ratchet profiles 502, 504 and 506 together may control the linear ratcheting movement of the release tube 302. As the lock rings 308 engage the ratchet profiles 502, 504, and 506, the lock rings 308 may move, or contract, into the ratchet profiles 502, 504, and 506 as will be described in more detail below. The slope of the ratchet profiles 502, 504, and 506, as shown in FIG. 5A vary from one another, although it should be appreciated that the slopes may all be the same in an alternative exemplary embodiment.

FIG. 5B depicts a cross sectional detail of the first ratchet profile 502 according to an exemplary embodiment. The first ratchet profile 502, as shown, are two profiles around the external surface of the release tube 302 near the nose 324 of the release tube 302. The first ratchet profile 502 as shown has a two sloped side walls 508*a* on each side of a profile bottom 510*a*. The profile bottom 510*a* may engage the lock ring 308 when the lock ring 308 is in the first ratchet profile 502. The two sloped side walls 508*a*, as shown, are at 45 degree angles to the longitudinal axis of the release tube 302. The 45 degree slope of the two side walls 508*a* allow the lock rings 308 to slide into or out of the first ratchet profile 502 as the release tube 302 is moved uphole, or downhole relative to the collet 300. The 45 degree slope of the two side walls 508*a* also allows the lock rings 308 to require some increased longitudinal force on the release tube 302 in order to free the lock ring 308 from the first ratchet profile 502. Although the two side walls 508*a* of the first ratchet profile 502 are shown as sloped at 45 degree angles, it should be appreciated that any suitable angle or slope allowing for the lock ring 308 to slide out of the first ratchet profile 502 may be used for the slope.

FIG. 5C depicts a cross sectional detail of the second ratchet profile 504 according to an exemplary embodiment. The second ratchet profile 504, as shown, are four profiles around the external surface of the release tube 302 downhole of the first ratchet profiles 502 of the release tube 302. The second ratchet profile 504, as shown, has one sloped side wall 508*b* and a substantially perpendicular side wall 512*b* on each side of the profile bottom 510*b*. The profile bottom 510*b* is substantially the same as described above for profile bottom 510*a*. As shown, the sloped side wall 508*b* is located downhole, toward the tail end 500, and the substantially perpendicular side wall 512*b* is located uphole, toward the nose 324, relative to the profile bottom 510*b*.

As shown, the sloped side wall 508*b* is at a 30 degree angle to the longitudinal axis of the release tube 302. As shown, the substantially perpendicular side wall 512*b* is at an 85 degree angle to the longitudinal axis of the release tube 302. The 30 degree slope of the sloped side wall 508*b* allows the lock ring 308 to fall into the second ratchet profile 504 as the release tube 302 moves toward the collet 300; however, once the lock ring 308 is in the second ratchet profile 504, the substantially perpendicular side wall 512*b* will prevent the rock ring 308 from moving toward the nose 324. This linear ratcheting effect will prevent the release tube 302 from moving downhole relative to the second ratchet profile 504 once the lock ring 308 is engaged with in the profile (note that the ratcheting effect is less critical in profiles 502 and hence the slope of the two sloped side walls 508*a* may not vary between the sidewalls because in the exemplary embodiment shown the profiles 502 after being initially advanced are no longer in engagement with lock rings 308). Although the substantially perpendicular side wall 512*b* of the second ratchet profile 504 are shown as sloped at 85 degree angles, it should be appreciated that any suitable angle or slope capable of preventing lock ring 308 from unidirectionally sliding aft/out of the second ratchet profile 504 may be used for the slope. The 30 degree slope of the side walls 508*b* downhole of the profile bottom 510*b* allow the lock rings 308 to slide out of the second ratchet profile 504 as the release tube 302 is moved uphole relative to the collet 300. The 30 degree slope of the side walls 508*b* also allows the lock rings 308 to require some increased longitudinal force on the release tube 302 in order to free the lock ring 308 from the second ratchet profile 502. Although the side wall 508*b* of the second ratchet profile 504 are shown as sloped at 30 degree angles, it should be appreciated that any suitable angle or slope allowing for the lock ring 308 to unidirectionally slide fore/out of the second ratchet profile 504 (i.e. sufficient to ratchet) may be used for the slope.

FIG. 5D depicts a cross sectional detail of the third ratchet profile 506 according to an exemplary embodiment. The third ratchet profile 506, as shown, are nine profiles around the external surface of the release tube 302 downhole of the second ratchet profiles 504 toward the tail end 500 of the release tube 302. The third ratchet profile 506, as shown, has one sloped side wall 508*c* and a substantially perpendicular side wall 512*c* on each side of the profile bottom 510*c*. The profile bottom 510*c* is substantially the same as described above for profile bottom 510*a* and 510*b*. As shown, the sloped side wall 508*c* is located downhole, toward the tail end 500, and the substantially perpendicular side wall 512*c* is located uphole, toward the nose 324, relative to the profile bottom 510*c*.

As shown, the sloped side wall 508*c* is at a 45 degree angle to the longitudinal axis of the release tube 302. As shown, the substantially perpendicular side wall 512*c* is at an 85 degree angle to the longitudinal axis of the release tube 302. The 45 degree slope of the sloped side wall 508*c* allows the lock ring 308 to fall into the third ratchet profile 506 as the release tube 302 moves toward the collet 300; however, once the lock ring 308 is in the third ratchet profile 506, the substantially perpendicular side wall 512*c* will prevent the rock ring 308 from moving toward the nose 324. This linear ratcheting effect will prevent the release tube 302 from moving downhole relative to the third ratchet profile 506 once the lock ring 308 is engaged with in the profile. Although the substantially perpendicular side wall 512*c* of the third ratchet profile 506 are shown as sloped at 85 degree angles, it should be appreciated that any suitable angle or slope capable of preventing lock ring 308 from unidirectionally sliding aft/out of third ratchet profile 506 may be used for the slope.

The 45 degree slope of the side walls 508*c* downhole of the profile bottom 510*c* allows the lock rings 308 to slide out of the third ratchet profile 506 as the release tube 302 is moved uphole relative to the collet 300. The 45 degree slope of the side walls 508*c* also allows the lock rings 308 to require some increased longitudinal force on the release tube 302 in order to free the lock ring 308 from the third ratchet profile 506. Although the side wall 508*c* of the third ratchet profile 506 are shown as sloped at 45 degree angles, it should be appreciated that any suitable angle or slope allowing for the lock ring 308 to slide unidirectionally fore/out of the third ratchet profile 506 may be used for the slope.

Although there are two of the first ratchet profiles 502 located near the nose 324, four second ratchet profiles 504 located between the first ratchet profiles 502 and the third ratchet profiles 506 and nine third ratchet profiles 506 located near the tail end 500, it should be appreciated that there may be any suitable number and combination of ratchet profiles 502, 504 and 506, located at any suitable location along the release tube 302.

Figure 6A:
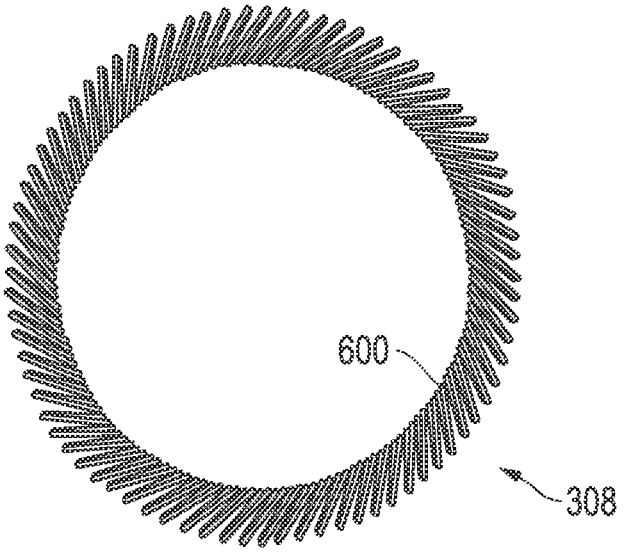
FIG. 6A depicts a lock ring according to an exemplary embodiment.
Figure 6B:
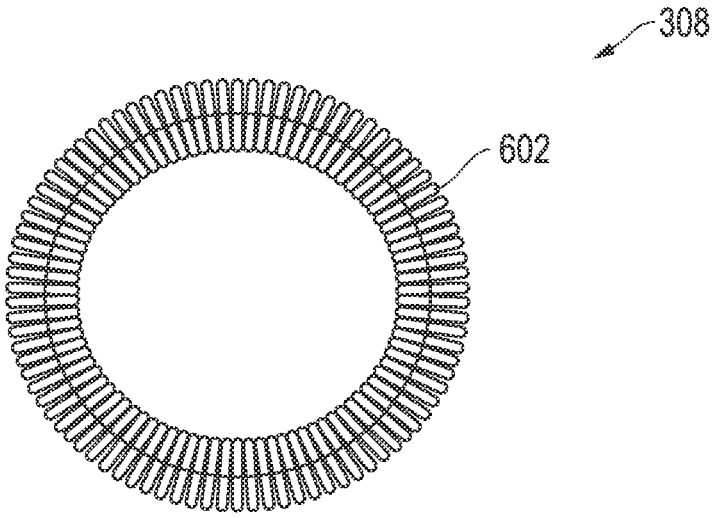
FIG. 6B depicts a lock ring according to an alternative exemplary embodiment.
Figure 6C:
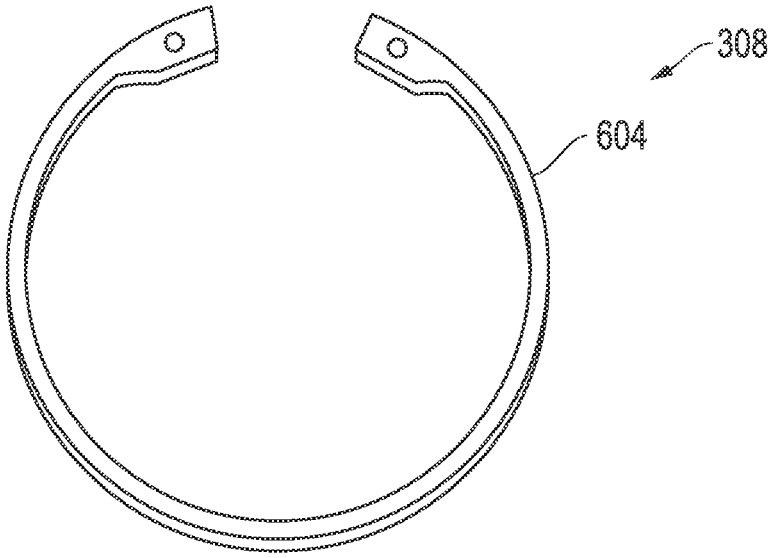
FIG. 6C depicts a lock ring according to an alternative exemplary embodiment.

FIGS. 6A-6C depict the lock ring 308 according to different exemplary embodiments. As shown in FIG. 6A, the lock ring is a canted coil spring 600. The canted coil spring 600 may rest on the outer surface of the release tube 302 (as shown in FIGS. 3 and 5). The canted coil spring 600 may be biased radially toward the center of the release tube 302. As the ratchet profiles move into contact with the lock ring(s) 308, the lock ring 308 will bias into the ratchet profiles 502, 504 and/or 506 (as shown in FIGS. 5A-D). The lock ring(s) 308 may then control relative movement of the release tube 302 using the ratchet profiles 502, 504 and/or 506. Although the lock ring 308 is shown as the canted coil spring 600 in FIG. 6A it should be appreciated that the lock ring 308 may be any suitable biasing member capable of controlling the movement of the release tube 302 and the downhole tool 102 including, but not limited to, a snap spring, a garter spring 602 (as illustrated in FIG. 6B), a c-ring 604 (as illustrated in FIG. 6C), a key ring, a radial spring, split rings, cotter rings, snap rings and the like.

Returning to FIG. 3, the release device 108 may include a compression spring 304, a collet mandrel 330, a motive member mandrel 332, a motive member 336, and a housing mandrel 338. The compression spring 304 may be a biasing member between a collet mandrel 330 and a motive member mandrel 332. The compression spring 304 may be configured to compress upon a substantial uphole force being applied to the conveyance 112 (as shown in FIG. 1). When the compression spring 304 compresses, the release tube 302 may move longitudinally uphole as will be discussed in more detail below. The substantial force may prevent the compression spring 304 from compressing inadvertently with small impacts from the conveyance 112. In an exemplary embodiment, the substantial force is 1000 lbs.-force (4448 newtons). Although the substantial force is described as 1000 lbs.-force, it should be appreciated that the substantial force may be any suitable force including, but not limited to a force between 100 and 10000 lbs.-force and in some working examples, between 1000-1500 lbs.-force. Further, biasing members 322 around collet 300 may radially expand at a lower force than the substantial force applied to compression spring 304. As shown, the compression spring 304 is a coiled spring, although it should be appreciated that the compression spring 304 may be any suitable biasing member capable compressing upon the conveyance 112 applying the substantial force.

The collet mandrel 330 may be a mandrel located longitudinally downhole of the collet 300. The collet mandrel 330 may be located radially outside of the outer wall of the release tube 302. The collet mandrel 330 may have one or more lock ring profiles 334 configured to house the lock rings 308 in a longitudinal position relative to the release tube 302 as the release tube 302 moves longitudinally along the downhole tool 102. The motive member mandrel 332 may be located near the tail end 500 of the release tube 302 and be radially outside of the release tube 302. The motive member mandrel 332 may have the one or more lock ring profiles 334 as described above. The motive member mandrel 332 may be engaged by, for example, a shoulder 312 of the motive mandrel 336, or alternatively, may be integral with a motive member 336.

The housing mandrel 338 may be an outer housing that couples the upper end of the downhole tool 102 to the motive member mandrel 332. The housing mandrel 338 may protect the equipment inside the downhole tool 102 and provide a mechanical link between the conveyance 112 and the motive member mandrel 332.

During downhole operations, if the downhole tool 102 and/or downhole device 110 fails or becomes stuck during operation, or if the operators otherwise want to remove the downhole tool 102 from the tubular 104, the release device 108 may be activated to release the downhole tool 102 from the downhole device 110. The release procedure starts by applying uphole force to the conveyance 112. The uphole force may then be transferred to the housing mandrel 338. Consequently pulling up on housing mandrel 338 pulls up on motive member mandrel 332 which compresses the compression spring 304 against the collet mandrel 330 due to the fact that the release rod 306 is connected to the downhole device 110 (which is set, stuck, or plugged in place). If the uphole force is greater than the substantial force of the compression spring 304 the release tube 302 will begin to move uphole relative to the collet 300 each cycle that the compression spring 304 compresses (i.e. the lock rings 308 of collet mandrel 330 and motive member mandrel 332 latch onto the next set of ratchet profiles 502, 504, and/or 506 downhole on the release tube 302 as it travels longitudinally uphole).

In the initial, or locked, position of the release device 108, the uphole lock rings 308*a* are located in the first ratchet profiles 502 and the downhole lock rings 308*b* are located in the uphole-most profiles of third ratchet profiles 506. Uphole force from conveyance 112 transfers to housing mandrel 338 and motive member mandrel 332 to compress the compression spring 304. As compression spring 304 is compressed sufficiently between the collet mandrel 330 and the motive member mandrel 332, the release tube 302 is able to travel longitudinally relatively toward the collet 300 such that the uphole lock rings 308*a* latch onto the uphole-most set of the second ratchet profiles 504. After the force is relieved, the compression spring 304 expands and causes the housing mandrel 338 and the motive member mandrel 332 to return to its initial position relative to the release rod 306. Because of the substantially perpendicular profiles 512*b*, the uphole lock rings 308*a* are retained in their respective ratchet profiles 504 on release tube 302, and thus helping to move the release tube 302 uphole relative to its initial position. The downhole lock rings 308*b* slip down the subsequent downhole sloped side walls 508*c* of the third ratchet profiles 506 as the release tube 302 moves relatively uphole. The ratchet profiles 502, 504 and/or 506 may optionally provide the operator an indication via a sensor (not illustrated) which ratchet profile 502, 504 and/or 506 the lock rings 308 have reached and to further prevent the release tube 302 from downhole movement relative to collet 300. As the release tube continues uphole, the lock rings 308 may engage the second, and third ratchet profiles 504, and 506 in order to prevent the downhole movement of release tube 302.

Repeatedly applied force moves the nose 324 of the release tube 302 into the collet 300 as the release tube 302 is repeatedly ratcheted uphole. The release ramp 326 may then engage the first inner ramp 316 of the collet 300. The longitudinal movement of the release tube 302 uphole against the first inner ramp 316 may cause the collet 300 to radially expand against the one or more biasing members 322. As the nose 324 of the release tube 302 moves longitudinally past the first inner ramp 316 of the collet 300, the collet 300 may be partially radially expanded. In this position, the locking shoulder 314 of the release rod 306 may still be engaged with the collet shoulder 320. Continued applied uphole force may engage the release ramp 326 with the second inner ramp 318. As the nose 324 of the release tube 302 moves longitudinally past the cylindrical inner wall 328 of the collet 300, the collet 300 may be fully radially expanded until the collet shoulder 320 disengages the locking shoulder 314 of the release rod 306. The collet 300 may be further expanded, if necessary, by moving the release tube 302 further uphole (i.e. in one working exemplary embodiment it is not necessary for the release ramp 326 of nose 324 to engage the second inner ramp 318 to fully release the release rod 306 although the second inner ramp 318 may be included as a back-up or assurance release device to ensure that the release rod 306 is released in practice). Upon release, the release spring 310 may force the release rod 306 downhole and out of the collet 300, or the release rod 306 may be dropped out downhole as the downhole tool 102 is retrieved out of the wellbore 106. As shown, the release spring 310 is a coiled spring that engages a ball 340, although it should be appreciated that the release spring 310 may be any suitable biasing device. The force of the release spring 310 in combination with the uphole force and the force stored in the compression spring 306 will move the release device uphole relative to the release rod 306 thereby releasing the downhole tool 102 from the wellbore.

In one exemplary embodiment, the release tube 302 requires at least three applications of sufficient force to the conveyance 112 to fully expand collet 300 to disengage the release rod 306. This requirement prevents inadvertent disengagement of release rod 306 and is reflected in the number of sets of the third ratchet profile 506 as illustrated in the figures. However, it is to be appreciated that any number of first second and third ratchet profiles 502, 504 and/or 506 and any number of lock rings 308 may be combined or utilized to insure against inadvertent release.

Figure 7:
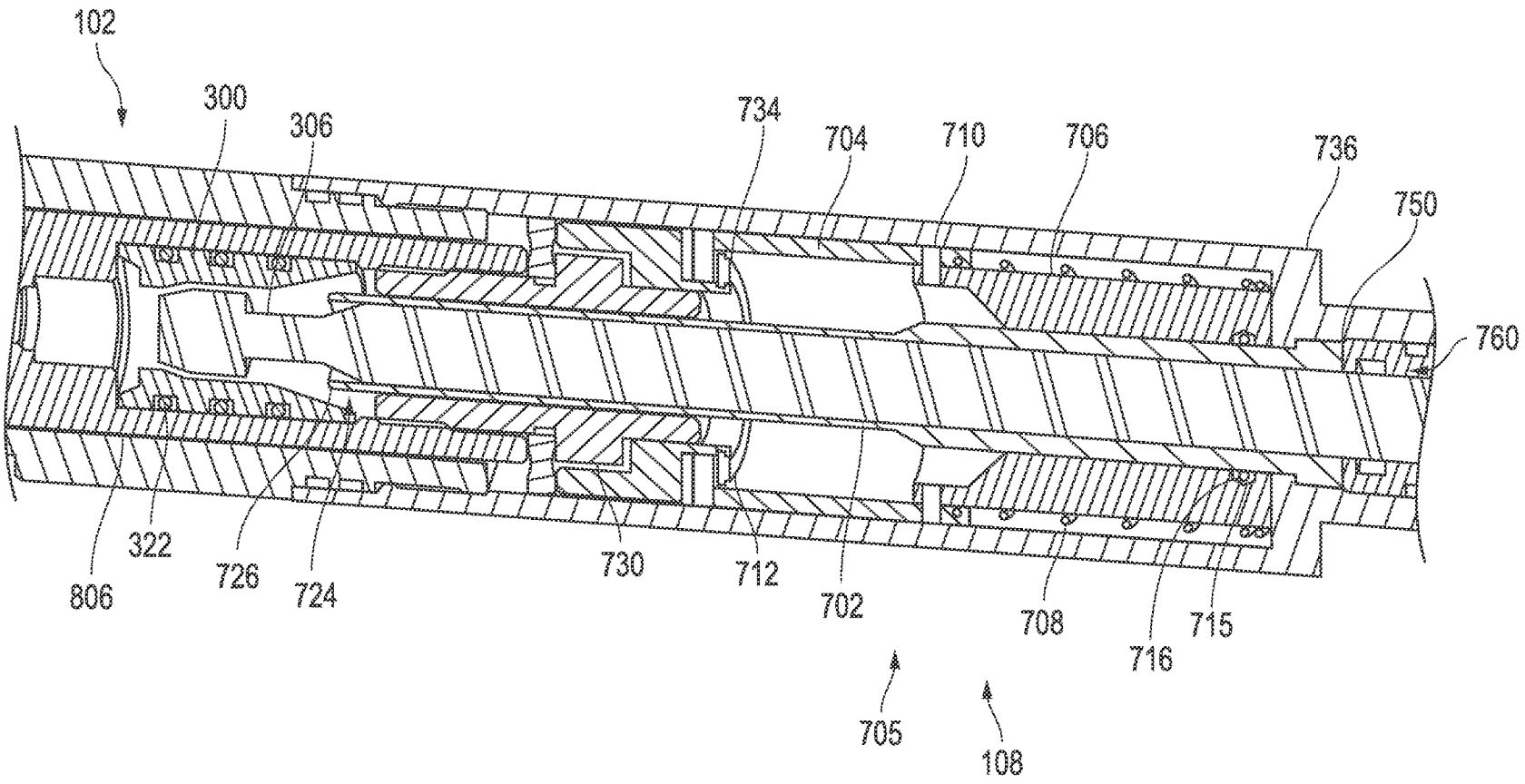
FIG. 7 depicts a cross sectional view of the radial ratchet release device of the downhole tool according to an alternative exemplary embodiment.
Figure 8:
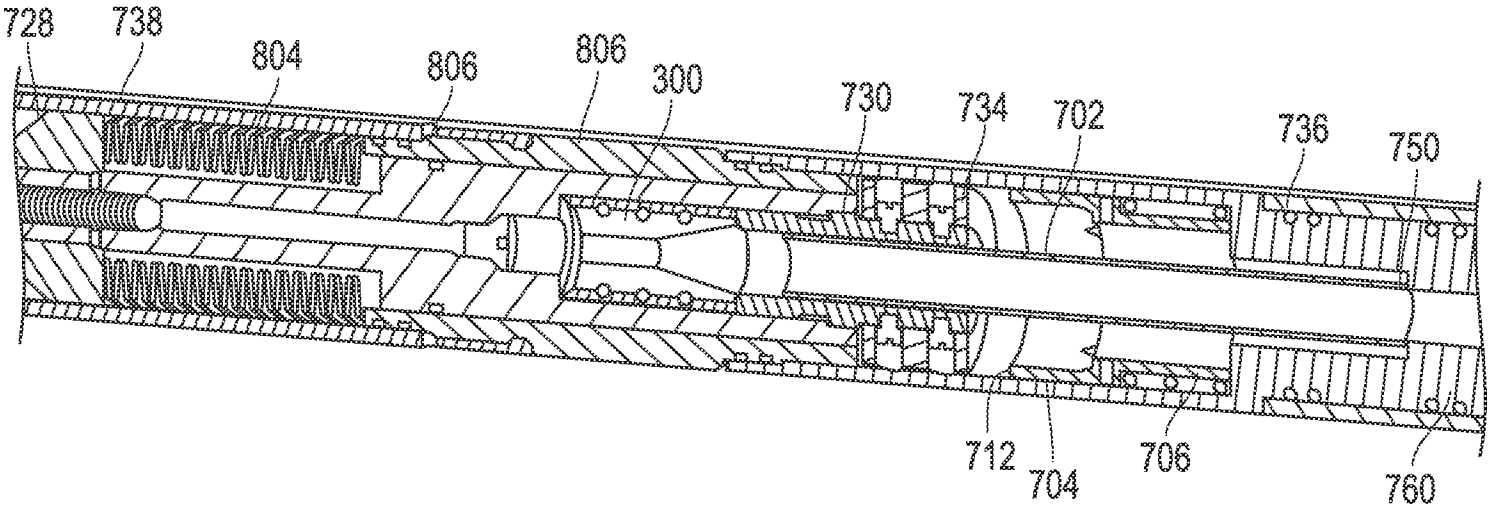
FIG. 8 depicts a cross sectional view of the radial ratchet release device of the downhole tool according to an alternative exemplary embodiment.
Figure 9:
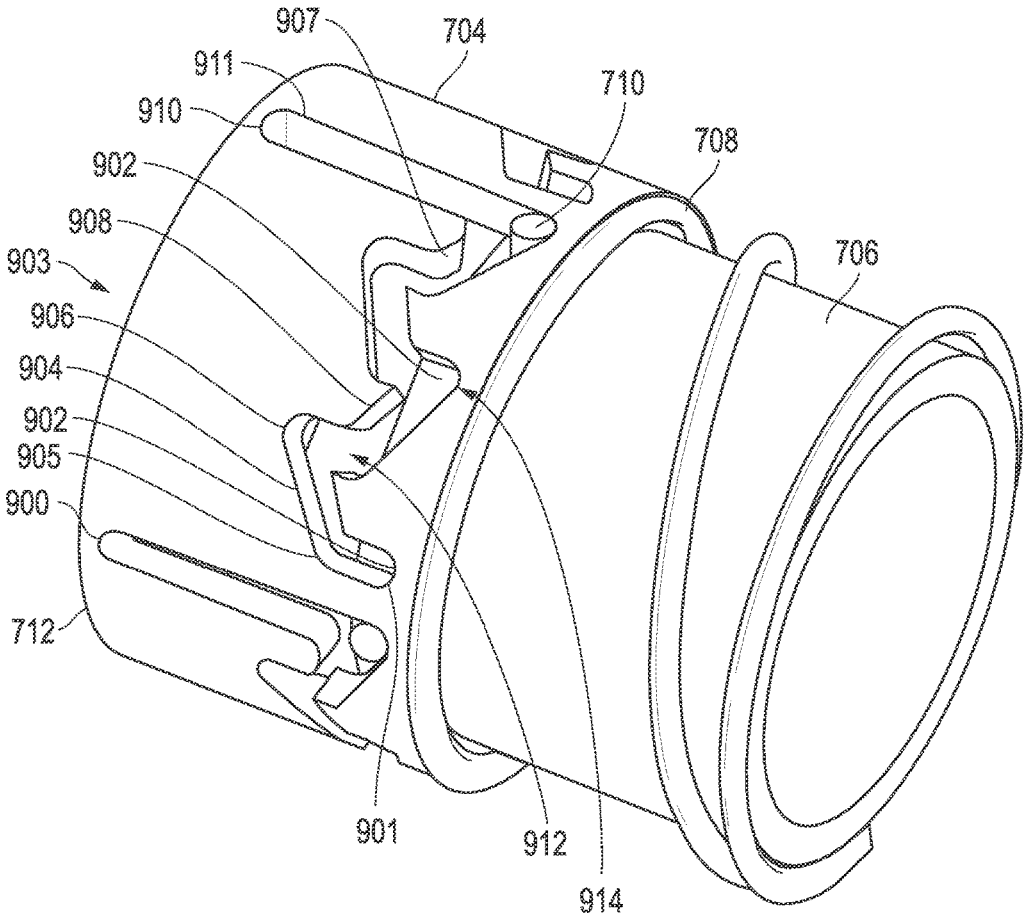
FIG. 9 depicts a perspective view of the radial ratchet release device inner and outer sleeves according to an alternative exemplary embodiment.

Alternate exemplary embodiments of the release device 108 are depicted in FIGS. 7, 8, and 9. Exemplary embodiments depicted within FIGS. 7, 8, and 9 feature a release device 108 utilizing a radial ratchet mechanism 705 to release the downhole tool 102 from the wellbore. The conveyance 112, release rod 306 and collet 300 (along with biasing members 322 and biasing grooves 400) depicted in the radial ratchet mechanism 705 exemplary embodiments may be substantially similar and function similarly to the conveyance 112, release rod 306 and collet 300 in the linear ratchet mechanism 305 exemplary embodiments described in the paragraphs above. The downhole tool 102 which utilizes radial ratchet mechanism 705 may also include a motor 202, a pump 204, a bottom tandem sub 806, a controller 208, a connector 210 and a downhole device 110 (see FIG. 1). Further, the radial ratchet mechanism 705 as part of an exemplary embodiment of release device 108 may further include a release tube 702, a radial ratchet outer sleeve 704, a radial ratchet inner sleeve 706, pin(s) 710, a collet mandrel 730, a housing mandrel 738, a radial ratchet spring 708, and a motive mandrel member 736. As depicted in FIG. 7, the release device 108 has disengaged from a release rod 306.

On FIGS. 7 and 8, the left hand side of the release device 108 is the uphole and proximal side of the downhole tool 102 and the right hand side of the release device 108 is the downhole and distal side of the downhole tool 102. As uphole force is applied to the conveyance 112, the uphole force may then be transferred to the housing mandrel 738. Consequently, pulling up on housing mandrel 738 pulls up on bottom tandem sub 806 which compresses the compression spring 804 against the proximal mandrel 728 located at the other end of the compression spring 804 due to the fact that the release rod 306 is connected to the downhole device 110 (which is set, stuck, or plugged in place). If the uphole force is greater than the substantial force of the compression spring 804, effectively via the radial ratchet mechanism 705 to be further described below, the release tube 702 will move uphole relative to the collet 300 each cycle that the compression spring 304 compresses. Once the compression spring 804 has been compressed to its limit, the force on the conveyance 112 may be reduced or removed to allow the compression spring 804 to expand. The process is repeated until the release tube 702 fully motivates the collet 300 away from the release rod 306 thereby releasing the release rod 306 from the release device 108 and the downhole tool 102, as will be discussed in more detail below.

Examples of exemplary embodiments of release tube 702 are depicted in FIGS. 7 and 8. The release tube 702 may have the nose 724, the release ramp 726, a tail end 750, and one or more stability profiles 715. Release tube 702 defines the nose 724 and release ramp 726 towards the proximal or uphole end. While release tube 702 is not identical to release tube 302, the interaction between nose 724 and release ramp 726 and collet 300 is very similar to the process between release tube 302 and collet 300 for releasing release rod 306, as will be described in further detail below. After the nose 724 of the release tube 702 passes the first inner ramp 316, the release tube 702 may pass a cylindrical inner wall 328 of the collet 300 to fully release the release rod 306. As shown, the cylindrical inner wall 328 is a substantially cylindrical inner wall of the collet 300 between the first inner ramp 316 and the second inner ramp 318. Although, the collet 300 is shown having the cylindrical inner wall 328 between the first inner ramp 316 and the second inner ramp 318, it should be appreciated that there may be no space between the first inner ramp 316 and the second inner ramp 318. Once the nose 724 passes the cylindrical inner wall 328, the nose 724 may engage the second inner ramp 318 with continued uphole longitudinal movement of the release tube 702 to further expand the collet 300, if necessary (i.e. in one working exemplary embodiment it is not necessary for the nose 724 to engage the second inner ramp 318 to fully release the release rod 306 although the second inner ramp 318 may be included as a back-up or assurance release device to ensure that the release rod 306 is released in practice). Although the exemplary embodiment illustrates two inner ramps of collet 300, it is to be appreciated that any combination of number of inner ramps and cylindrical walls may be implemented.

The first inner ramp 316, cylindrical inner wall 328, and second inner ramp 318 may be configured to receive the nose 724 of the release tube 702. The longitudinal movement of the release tube 702 may move the collet 300 radially away from the release rod 306 to the release position due to the release ramp 726 moving along the cylindrical inner wall 328. The angle of the first inner ramp 316 and the second inner ramp 318 may be the same in an exemplary embodiment. Alternatively, the second inner ramp 318 may have a different angle that the first inner ramp 316. For example, the first inner ramp 316 may have a slight angle configured to slowly move the collet radially away from the release rod 306 with longitudinal movement of the release tube 702 and the second inner ramp 318 may have a steep angle that moves the collet at a larger distance radially with the same longitudinal movement of the release tube 702, or vice versa.

In addition to release tube 702, radial release mechanism 705 further includes radial ratchet outer sleeve 704, radial ratchet sleeve inner sleeve 706, radial spring 708 and pin(s) 710. Radial ratchet inner sleeve 706 defines a stability profile or detent 711 on the inner surface of the radial ratchet inner sleeve 706 stability profile 711 faces stability profile 715, which is defined on the outer surface of release tube 702, forming an annulus to house a stability ring 716. The stability ring 716 may be utilized to retain and stabilize the release tube 702 relative to radial ratchet inner sleeve 706 and to stabilize radial ratchet inner sleeve 706 with respect to radial ratchet outer sleeve 704.

FIG. 9 depicts a perspective view of the radial ratchet outer and inner sleeves 704 and 706 according to an exemplary embodiment. A radial spring 708 surrounds radial ratchet inner sleeve 706 and engages radial ratchet outer sleeve 704 at a proximal end. As depicted, radial spring 708 is a coiled spring, although it should be appreciated that the radial spring 708 may be any suitable biasing member capable of compressing upon the conveyance 112 applying sufficient force, and may require less force to compress than is necessary for compression spring 804. Radial ratchet outer sleeve 704 also features a shoulder 712 which may abut against motive member shoulder 734 when uphole force is exerted on conveyance 112. In addition, the outer circumference of radial ratchet inner sleeve 706 is of a smaller diameter than the internal circumference of radial ratchet outer sleeve 704. Thus, radial ratchet inner sleeve 706 can slidably move into and out of radial ratchet outer sleeve 704. A plurality of pins 710 are attached to the proximal end of radial ratchet inner sleeve 706 and juts out beyond the outer circumference of radial ratchet inner sleeve 706 to engage a number of slots/J-slots 900 or the like defined on radial ratchet outer sleeve 704.

Each slot/J-slot 900 may include or initiates as a patterned-groove portion 903 described as a plurality of valleys 914 and peaks 912 and defined by a continuous void or groove. The patterned-groove portion 903 is determined by an initial point 901, a plurality of distal points 902, a plurality of uphole slopes 904 (which may include a plurality of first intermediate points 905), a plurality of proximal points 906, a plurality of downhole slopes 908 (which may include a plurality of second intermediate points 907), a disengagement slot 910, and a disengagement point 911 wherein the proximal direction is closer uphole, and the distal direction is closer downhole. Each of the slots/J-slots 900 engages a pin 710. The patterned-groove portion 903 or combination of the initial point 901, the distal points 902, the uphole slopes 904, the proximal points 906, the downhole slopes 908, the disengagement slot 910, and the disengagement point 911 defines the path along which pin 710 travels. Because each of the pins 710 is joined or coupled to the radial ratchet inner sleeve 706, which in turn, is collapsible into the radial ratchet outer sleeve 704 effective to allow further upward motion and drive the release tube 702 via a tube motive 760, movement of the pin 710 along the path defined by the slot/J-slot 900 transfers longitudinal movement to the release tube 702. The length of the disengagement slot 910 is designed such that movement of the pin 710 to the disengagement point 911 causes the nose 724 of the release tube 702 to engage and fully radially expand the collet 300 due to movement of the release tube 702 longitudinally uphole. As in the previous exemplary embodiments, when the collet 300 is fully expanded, the release rod 306 is released and the downhole tool 102 may be retrieved from the wellbore 106. The patterned-groove portion 903 described as a plurality of valleys 914 and peaks 912 functions as a safety release mechanism in that the pin 710 must travel through the patterned-groove portion 903 prior to reaching the disengagement slot 910 portion, and the disengagement point 911 portion of the groove.

When sufficient uphole force is applied to the conveyance 112, the bottom tandem sub 806 applies a force to the compression spring 804. When the compression spring 804 compresses, upon working sufficiently through a circumferential ratcheting mechanism, the release tube 702 may move longitudinally uphole as will be discussed in more detail below. The substantial force may prevent the compression spring 804 from compressing inadvertently with small impacts from the conveyance 112. In an exemplary embodiment, the substantial force is 1000 lbs.-force (4448 newtons). Although the substantial force is described as 1000 lbs.-f, it should be appreciated that the substantial force may be any suitable force as previously described. The biasing members 322 may radially expand at a lower force than the substantial force necessary for the compression spring 304. As shown, the compression spring 804 is a coiled spring, although it should be appreciated that the compression spring 804 may be any suitable biasing member capable compressing upon the conveyance applying the substantial force.

The collet mandrel 730 may be a mandrel located longitudinally downhole of the collet 300. In addition, the collet mandrel 730 may be located radially outside of the outer wall of the release tube 702. A motive member shoulder 734 may be integral to or attached to the end of collet mandrel 730.

Once the downhole device 110 is in place in the tubular 104 (as shown in FIG. 1), the downhole operations may be performed. If the downhole tool 102 and/or downhole device 110 fails or becomes stuck during operation, or if the operators otherwise want to remove the downhole tool 102 from the tubular 104, the release device 108 may be activated to release the downhole tool 102 from the downhole device 110. The release procedure starts by applying uphole force to the conveyance 112 (shown in FIG. 2). The uphole force may then be transferred to the housing mandrel 738. Consequently pulling up on housing mandrel 738 pulls up on bottom tandem sub 806 which compresses the compression spring 804 against the proximal mandrel 728 due to the fact that the release rod 306 (shown in FIG. 3) is connected to the downhole device 110 (which is set, stuck, or plugged in place). If the uphole force is greater than the substantial force of the compression spring 804 the continued upward motion of housing mandrel 738 will cause the motive mandrel member 736 to move uphole relative to the collet 300. The uphole force from the motive mandrel member 736 is transferred to the radial ratchet inner sleeve 706 which compresses the radial spring 708 as the radial ratchet inner sleeve 706 moves uphole into the radial ratchet outer sleeve 704 (as shoulder of outer sleeve 712 is opposed by the collet mandrel 730 and motive member shoulder 734 due to release rod 306 being anchored downhole by downhole device 110). As the radial ratchet inner sleeve 706 moves into the radial ratchet outer sleeve 704 from the initial position, the pin(s) 710 move respectively from the initial point 901 past the first intermediate point 905 through the uphole slope 904 and to the proximal point 906. As the upward force is relieved upon release of compression force, the radial ratchet inner sleeve 706 moves distally away from the radial ratchet outer sleeve 704 as the radial spring 708 decompresses. As the radial spring 708 decompresses, the pin 710 moves from the proximal point 906 through the downhole past the second intermediate point 907, next through slope 908 and, then to the next distal point 902. This combination of the distal points 902, the uphole slopes 904, the first intermediate points 905, the proximal points 906, the second intermediate points 907, and the downhole slopes 908 creates a ratcheting mechanism having a pattern which may be repeated as many times as necessary (as a safety device) to insure against or prevent inadvertent release of the release rod 306. As illustrated in FIG. 9, there are two sets of distal points 902, uphole slopes 904, first intermediate points 905, proximal points 906, second intermediate points 907 and downhole slopes 908, however, any number of sets of these points may be combined to insure against accidental release as may be determined by one of ordinary skill in the art (or if desired, it may not repeat and contain only one set of a peak 912 and a valley 914). In one working example on the third application of sufficient force to the conveyance 112 for the exemplary embodiment of the radial ratchet mechanism 705 in FIG. 9, when the pin 710 is in the disengagement slot 910, the radial ratchet inner sleeve 706 moves the uphole direction into the radial ratchet outer sleeve 704 as the pin 710 travels towards the disengagement point 911. Although FIG. 9 depicts and is discussed with respect to an exemplary embodiment and working example utilizing three applications of force, it should be appreciated that any number of applications of force in excess of two for assurance of safety or assurance that a false release does not occur (or is inhibited) may be used. Because the radial ratchet inner sleeve 706 can now fully enter radial ratchet outer sleeve 704 via interaction between the pin(s) 710 and now the longest slot terminating at disengagement slot 910, further upward motion of housing mandrel 738 further pulls up the motive mandrel member 736 which now engages tube motive 760 which will be driven upwardly into abutment with the tail end 750 of the release tube 702. The nose 724 of the release tube 702 travels uphole the length of the disengagement slot 910 into the collet 300, fully disengaging the collet 300 from the release rod 306 by pushing the release ramp 726 uphole past the first inner ramp 316 towards the cylindrical inner wall 328 and allowing the release rod 306 to drop from within the release tube 702 into the wellbore 106.

While the exemplary embodiments are described with reference to various implementations and exploitations, it will be understood that these exemplary embodiments are illustrative and that the scope of the inventive subject matter is not limited to them. Many variations, modifications, additions and improvements are possible and may extend to industries beyond wellbore drilling wherein tools need to be released at a distance and subsequently retrieved (by way of example only, and not limited to mining, plumbing, and other appropriate industries).

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. A downhole tool having a release device for releasing a downhole device in a wellbore, the downhole tool comprising:

a collet having an inner surface and a collet shoulder;

a release rod configured to engage the collet shoulder in a locked position and disengage from the collet shoulder in a release position;

a release tube surrounding the release rod and having a release ramp proximate a nose of the release tube; and a lock ring mounted external to the release tube, wherein the release tube further defines at least two ratchet profiles configured to engage the lock ring.

2. The downhole tool of claim 1, wherein the release ramp is configured to engage the inner surface of the collet to move the collet radially outward from the release rod and into the release position.

3. The downhole tool of claim 2, wherein the collet further comprises at least two collet pieces that form the collet.

4. The downhole tool of claim 3, further comprising a biasing member around an outer perimeter of the collet pieces configured to bias the collet pieces toward the release rod.

5. The downhole tool of claim 4, further comprising a compression spring proximate the release device configured to prevent the release device from inadvertent release.

6. The downhole tool of claim 5, wherein the release rod has a locking shoulder configured to engage a collet shoulder in the locked position.

7. A method for releasing a downhole device from a downhole tool within a tubular, comprising the steps of:

applying an uphole force to a conveyance connected to the downhole tool, and wherein the conveyance is configured for delivering the downhole tool to the tubular;

preventing accidental release of the downhole device in the tubular, wherein the step of preventing accidental release comprises the step of radially ratcheting a release device; and releasing the downhole device.

8. The method of claim 7, further comprising the step of retrieving the downhole tool from the tubular.

9. A method for releasing a downhole device connected to a downhole tool within a tubular, comprising the steps of:

applying an uphole force to a conveyance attached to the downhole tool;

transferring the uphole force to the downhole device, wherein the step of transferring the uphole force to the downhole device further comprises compressing a compression spring;

sliding a nose defined on a release tube into an inner surface defined in a collet;

motivating the collet radially away from a release rod; and releasing the release rod.

10. The method of claim 9, further comprising repeating at least once the steps of:

applying the uphole force to the conveyance attached to the downhole tool; and transferring the uphole force to the downhole device.

11. The method of claim 10, further comprising the step of moving the release tube uphole.

12. The method of claim 9, further comprising the steps of releasing the downhole device and retrieving the downhole tool from the tubular.

13. The method of claim 12, wherein the release tube further defines a first ratchet profile on the release tube; and further comprising the step of latching a lock ring onto the first ratchet profile.

14. The method of claim 13, further comprising the step of sliding the lock ring out of the first ratchet profile.

15. The method of claim 14, further comprising the step of latching the lock ring onto a second ratchet profile defined on the release tube simultaneously with the step of moving the release tube uphole.

16. The method of claim 12, wherein the release tube is connected to an inner sleeve;

wherein the inner sleeve is coupled to a pin, and wherein the pin is engaging a slot defined in an outer sleeve.

17. The method of claim 16, further comprising the steps of moving the pin along the slot in response to the step of applying the uphole force; and sliding the inner sleeve within the outer sleeve.

18. The method of claim 17, wherein the slot at one end defines a disengagement slot ending in a disengagement point, and further comprising the steps of moving the pin along the disengagement slot to the disengagement point; and engaging the nose of the release tube with the inner surface of the collet when the pin is within the disengagement slot.

19. A downhole tool apparatus for releasing a downhole device in a wellbore, comprising:

a release tube having a nose proximate a release ramp;

a plurality of ratchet profiles defined on the release tube; and a plurality of lock rings engaged with the plurality of ratchet profiles defined on the release tube.

20. The downhole tool apparatus of claim 19, further comprising a release rod within the release tube.

21. The downhole tool apparatus of claim 20, further comprising a collet having an inner surface, wherein the collet is configured to engage the release rod when in a locked position of the downhole apparatus.

22. The downhole tool apparatus of claim 21, wherein the inner surface of the collet is configured to engage the nose and the release ramp of the release tube when in a release position of the downhole apparatus.

23. The downhole tool apparatus of claim 22, further comprising a biasing member surrounding an outer perimeter of the collet.

24. A downhole tool apparatus for releasing a downhole device in a wellbore, comprising:

a release tube;

an inner sleeve connected to the release tube;

a pin connected to the inner sleeve;

an outer sleeve defining a slot with which the pin is engaged, wherein the inner sleeve is configured to slidably move within the outer sleeve; and a radial spring surrounding the inner sleeve.

25. The downhole tool apparatus of claim 24, further comprising a release rod at least partially within the release tube and a collet surrounding the release rod.

26. The downhole tool apparatus of claim 25, wherein the release tube is at least partially between the collet and the release rod when in a release position of the downhole tool apparatus.

27. The downhole tool apparatus of claim 26, wherein the slot defines a disengagement slot configured to guide the pin and the downhole tool apparatus to a release position.

28. The downhole tool apparatus of claim 27, further comprising a biasing member surrounding the collet.

29. The downhole tool apparatus of claim 24, wherein the slot defines a pattern configured to prevent the release device from inadvertent release, and wherein the slot further defines a disengagement slot configured to guide the pin and the release tube in an uphole direction.

30. The downhole tool apparatus of claim 24, further comprising:

a conveyance connected to the downhole tool apparatus; and a housing mandrel coupled to the conveyance and to the downhole tool apparatus.

31. The downhole tool apparatus of claim 30, further comprising:

a collet mandrel downhole of the collet;

a bottom tandem sub, wherein the bottom tandem sub surrounds the collet mandrel, and wherein the housing mandrel is configured to transfer uphole force to the bottom tandem sub; and a motive member shoulder adjacent to the outer sleeve.

* * * * *